United States Patent [19]

Plunkett

[11] Patent Number: 4,460,310

[45] Date of Patent: Jul. 17, 1984

[54] DIFFUSER THROTTLE RING CONTROL

[75] Inventor: Francis P. Plunkett, Syracuse, N.Y.

[73] Assignee: Carrier Corporation, Syracuse, N.Y.

[21] Appl. No.: 392,981

[22] Filed: Jun. 28, 1982

[51] Int. Cl.[3] ..... F04D 27/02

[52] U.S. Cl. ..... 415/26; 415/27; 415/28; 415/48; 415/158

[58] Field of Search ..... 415/26, 27, 28, 48, 415/49, 158

[56] References Cited

U.S. PATENT DOCUMENTS

| | | | |
|---|---|---|---|
| 916,427 | 3/1909 | Fee . | |
| 2,996,996 | 8/1961 | Vassniker | 103/97 |
| 3,032,259 | 5/1962 | Vassniker | 230/114 |
| 3,251,539 | 5/1966 | Wolfe et al. | 230/114 |
| 3,289,919 | 12/1966 | Wood | 230/114 |
| 3,362,624 | 1/1968 | Endress | 230/114 |
| 3,362,625 | 1/1968 | Endress | 230/114 |
| 3,399,625 | 9/1968 | Skinner | 103/97 |
| 3,426,964 | 2/1969 | Silvern | 230/114 |
| 3,619,078 | 6/1970 | Endress et al. | 415/150 |
| 3,667,860 | 6/1972 | Endress et al. | 415/150 |
| 3,784,318 | 1/1974 | Davis | 415/158 |
| 4,070,132 | 1/1978 | Lynch | 415/48 |
| 4,219,305 | 8/1980 | Mount et al. | 415/13 |
| 4,257,733 | 3/1981 | Bandukwalla | 415/13 |

FOREIGN PATENT DOCUMENTS

| | | | |
|---|---|---|---|
| 305214 | 1/1929 | United Kingdom . | |
| 753316 | 7/1956 | United Kingdom . | |
| 1445016 | 12/1973 | United Kingdom | 415/148 |

OTHER PUBLICATIONS

U.S. patent application Ser. No. 137,173, filed 4/4/1980, Inventor-Edson H. Byrns—our ref. 4602.

U.S. patent appliction Ser. No. 193,505, filed 10/2/1980, Inventor-Phiroze Bandukwalla—our ref. 4542.

U.S. patent appliction Ser. No. 193,507, filed 10/2/1980, Inventor Phiroze Bandukwalla—our ref. 4541.

*Primary Examiner*—Stephen Marcus

*Assistant Examiner*—John Kwon

*Attorney, Agent, or Firm*—David L. Adour

[57] ABSTRACT

A centrifugal vapor compressor having a two-position, pressure controlled diffuser throttle ring is disclosed. The throttle ring is positively maintained in a minimum or a maximum throttling position by supplying either a relatively low pressure or a relatively high pressure, respectively, to a cavity behind the throttle ring. The throttle ring may be one of any of a variety or types of throttle rings including a new, improved throttle ring having a back portion with a sealing means which facilitates sliding movements of the throttle ring and which prevents vapor flow between the cavity behind the throttle ring and the diffuser passageway.

5 Claims, 2 Drawing Figures

DIFFUSER THROTTLE RING CONTROL

BACKGROUND OF THE INVENTION

The present invention relates to centrifugal vapor compressors and more particularly relates to methods and apparatus for controlling vapor flow through a diffuser passageway of a centrifugal vapor compressor.

Flow stabilization through a centrifugal vapor compressor is a major problem when the compressor is used in situations where the load on the compressor varies over a wide range of volumetric flow rates. The compressor inlet, impeller, and diffuser passageway must be sized to accommodate the maximum volumetric flow rate through the compressor. However, if the compressor inlet, impeller, and diffuser passageway are sized to accommodate the maximum volumetric flow rate then flow through the compressor may be unstable when there is a relatively low volumetric flow rate through the compressor. As volumetric flow rate is decreased from a relatively high stable range of flow rates, a range of slightly unstable flow is entered. In this range there appears to be a partial reversal of flow in the diffuser passageway which creates noise and lowers the efficiency of the compressor. Below this slightly unstable flow range, the compressor enters what is known as surge, wherein there are periodic complete flow reversals in the diffuser passageway which spoil the efficiency of the compressor and which may endanger the integrity of the compressor components.

Numerous compressor modifications have been developed for improving flow stability through a compressor at low volumetric flow rates because it is desirable to have a wide range of volumetric flow rates in many compressor applications. One such modification is the addition of guide vanes in the inlet passageway to the compressor. The guide vanes vary the flow direction and quantity of the entering vapor. In addition to inlet guide vanes, another widely known modification is to vary the width of the diffuser passageway in response to the load on the compressor. Normally, this is done by use of a diffuser throttle ring which moves laterally across the diffuser passageway to throttle vapor flow through the passageway.

Some variable diffuser throttle rings are controlled by relatively complex mechanisms for positioning and holding the throttle ring at any position between a minimum throttling position and a maximum throttling position. Typically, this type of diffuser throttle ring control is relatively expensive and often has fairly complex mechanical and/or pneumatic components. Normally, the manufacture and installation of these diffuser throttle ring controls are difficult and time consuming tasks requiring relatively expensive skilled manual labor.

While such continuously variable diffuser throttle rings often provide excellent results, it is known that very satisfactory results can be achieved with a diffuser throttle ring having a limited number of discrete, spaced throttling positions. For example, a diffuser throttle ring may be a two position device wherein the throttle ring is positioned in either a maximum or minimum throttling position. While obtaining satisfactory results, such a discretely variable diffuser throttle ring is much simpler than the continuously variable diffuser throttle rings described above. This simplicity reduces the construction costs, installation costs, and maintenance of the diffuser throttle ring and improves the reliability thereof.

Normally, a discretely variable diffuser throttle ring is located in an annular recess in the walls forming the diffuser passageway of the compressor, and the throttle ring is spring biased towards at least one of its throttling positions. For example, the throttle ring may be spring biased towards its maximum throttling position and a relatively low pressure source may be selectively connected to a cavity, formed between the walls of the annular reecess and the back surface of the throttle ring, to create a pressure difference across the throttle ring which forces the ring to its minimum throttling position against the spring action. U.S. Pat. No. 4,257,733 to Bandukwalla, et al. discloses such a two position, spring biased, diffuser throttle ring.

Also, U.S. Pat. No. 4,219,305 to Mount, et al. and now pending U.S. patent applications (all assigned to Carrier Corporation, Syracuse, N.Y.), Ser. No. 137,173 filed Apr. 4, 1980 entitled "A Centrifugal Vapor Compressor And A Method Of Setting A Maximum Throttling Position Thereof", Ser. No. 193,505 filed Oct. 2, 1980 entitled "Centrifugal Compressor", and Ser. No. 193,507 filed Oct. 2, 1980 entitled "Centrifugal Compressor", disclose spring biased throttle rings which may be classified in the general category of discretely variable, spring biased, diffuser throttle rings.

While providing overall good results, discretely variable diffuser throttle rings, such as those described above, are subject to normal wear as a result of vibrations of the throttle ring due to pressure variations in the diffuser passageway during operation of the compressor. Also, these vibrations of the throttle ring may create some undesirable noise.

SUMMARY OF THE INVENTION

Therefore, it is an object of the present invention to provide an improved centrifugal vapor compressor having a discretely variable diffuser throttle ring which is relatively long wearing.

It is another object of the present invention to provide an improved centrifugal vapor compressor having a discretely variable diffuser throttle ring which is relatively quiet in operation.

These and other objects of the present invention are attained by a centrifugal vapor compressor having a direct pressure controlled diffuser throttle ring mounted in an annular recess in the walls forming the diffuser passageway of the compressor. The throttle ring is mounted in the annular recess to form a substantially sealed cavity between the walls of the annular recess and the back surface of the throttle ring. Also, the throttle ring is supported in the annular recess for movement across the diffuser passageway between a minimum throttling position and a maximum throttling position depending on the pressure difference between the vapor pressure in the diffuser passageway and the pressure in the cavity behind the throttle ring.

A three-way valve controls the pressure in the cavity behind the throttle ring. The cavity is connected to a relatively low pressure source by the three-way valve when the volumetric vapor flow rate through the compressor is equal to or greater than a predetermined flow rate corresponding to stable flow conditions for the compressor. The cavity behind the throttle ring is connected to a relatively high pressure source by the three-way valve when the volumetric vapor flow rate through the compressor is less than the predetermined flow rate. The magnitudes of the low and high pressure sources are selected to provide a pressure difference across the throttle ring which positively maintains the throttle ring at its minimum throttling position or its maximum throttling position, respectively. This positive maintenance force, due to the pressure difference across the throttle ring, holds the ring in position and prevents vibrations of the ring, due to pressure variations in the diffuser passageway, which may cause wear and undesirable noise.

The throttle ring may be a conventional spring biased throttle ring or the ring may be a new, improved ring having a front part which controls flow through the diffuser passageway depending on the axial location of the front part within the diffuser passageway and having a back part which is slidably mounted in the annular recess to limit axial movement of the front part across the diffuser passageway between the minimum and maximum throttling positions. The back part may include a section made of a polymer material which is in contact with the walls of the annular recess to substantially prevent vapor flow between the cavity behind the throttle ring and the diffuser passageway, and which facilitates movement of the ring in the annular recesss. This polymer material may be a relatively soft material such as nitrile or a relatively hard material such as nylon. The surface area of the ring facing the diffuser passageway and the surface area of the ring facing the cavity are selected so that the throttle ring is properly positioned at its minimum throttling position or its maximum throttling position when the low pressure source or the high pressure source, respectively, is connected to the cavity behind the throttle ring.

BRIEF DESCRIPTION OF THE DRAWINGS

Other objects and advantages of the present invention will be apparent from the following detailed description in conjunction with th accompanying drawings, wherein like reference numerals identify like elements, and in which.

DESCRIPTION OF THE PREFERRED EMBODIMENT

Figure 1:
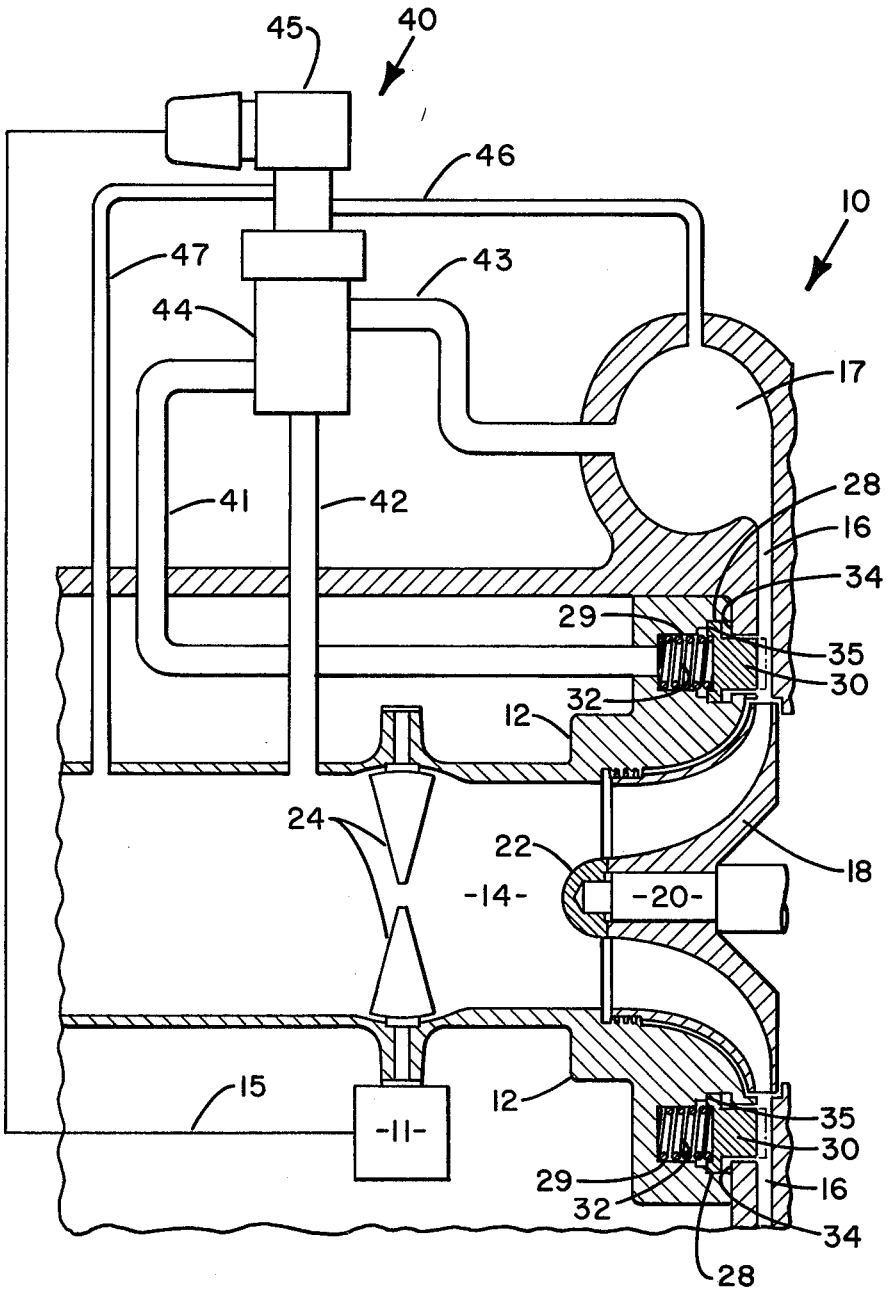
FIG. 1 is a side view, partly in cross section, of a portion of a centrifugal vapor compressor having a spring biased, direct pressure controlled diffuser throttle ring according to the present invention.

Referring to FIG. 1, there is shown a side view, partly in cross section of a portion of a centrifugal vapor compressor 10 having a spring biased, direct pressure controlled diffuser throttle ring 30 according to the present invention. As shown in FIG. 1, the compressor 10 includes a housing 12 which forms an inlet passageway 14, a diffuser passageway 16, and a discharge volute 17. Only portions of the housing 12 are shown in FIG. 1 since this type of housing is conventional in compressors of the kind under consideration. An impeller 18 is connected to a shaft 20 by a nut 22 to position the impeller 18 in the housing 12 between the inlet passageway 14 and the diffuser passageway 16. Inlet guide vanes 24 are journaled for rotation in the housing 12 and are positioned in the inlet passageway 14 to control the direction and quantity of vapor flow through the compressor 10. Actuator 11 controls the position of the inlet guide vanes 24.

There is a generally annular recess 28 defined by the housing 12 in the diffuser passageway 16. The diffuser throttle ring 30 is mounted in the annular recess 28 to form a substantially sealed cavity 29 between the walls of the annular recess and the back surface of the throttle ring 30. The diffuser throttle ring 30 is supported for movement within the annular recess 28 into diffuser passageway 16 between a minimum throttling position, shown in full lines in FIG. 1, and a maximum throttling position, shown in broken lines in FIG. 1. In the minimum throttling position the throttle ring 30 allows an essentially unrestricted flow of vapor through the diffuser passageway 16. In the maximum throttling position, the throttle ring 30 throttles vapor flow through the diffuser passageway 16.

As shown in FIG. 1, a resilient means 32 is provided for biasing the throttling ring 30 towards its maximum throttling position. The resilient means 32 may be a spring or a plurality of springs positioned within the annular recess 28. For example, as shown in FIG. 1, the resilient means 32 is plurality of springs equally spaced about the circumference of throttle ring 30 to form a ring of springs behind the throttle ring 30.

A first stop 34, which is an integral part of the housing 12, limits movement of the throttle ring 30 into the diffuser passageway 16 to prevent the throttle ring 30 from completely restricting vapor flow through the diffuser passageway 16. The stop 34 is designed so that movement of the throttle ring 30 into the diffuser passageway is limited at the maximum throttling position for the ring 30. A second stop 35, which is also an integral part of the housing 12, limits rearward movement of the throttle ring 30 to the minimum throttling position for the ring 30. In addition to limiting movement of the ring 30, the stops 34 and 35, when in contact with the throttle ring 30, provide a fluid seal between the diffuser passageway 16 and the cavity 29 behind the throttle ring 30.

A three-way valve 40 having a solenoid controlled, pilot pressure actuated valving element 44 controls the pressure in the cavity 29 behind the throttle ring 30 by regulating the pressure in a supply conduit 41 which is connected to the cavity 29. The cavity 29 is connected to either a high pressure source or a low pressure source via the supply conduit 41 through the valve 44. For example, as shown in FIG. 1, conduit 41 may be connected by valve 44 to a first conduit 42 which is connected to the compressor suction to provide a relatively low pressure in the cavity 29. Alternatively, the conduit 41 may be connected by the valve 44 to a second conduit 43 which is connected to the compressor discharge 17 to provide a relatively high pressure in the cavity 29. It should be noted that although in FIG. 1 the low pressure source and the high pressure source are shown as the compressor suction, and compressor discharge, respectively, any suitable low and high pressure source may be used which can provide the appropriate pressures in the cavity 29.

As shown in FIG. 1, the valve 44 is positioned for connection to either the first conduit 42 or the second conduit 43 by operation of a solenoid 45. Also, as shown in FIG. 1, the pilot pressures required for operation of the valving element 44 are supplied by a first sampling line conduit 46 which is connected to the compressor discharge 17 and by a second sampling line conduit 47 which is connected to the compressor suction. However, this is only one example of a source for the pilot pressures and it should be noted that any convenient source of suitable pilot pressures may be used to operate the valve 44.

Activation of the solenoid 45 is controlled in response to the volumetric vapor flow rate through the compressor 10. For example, as shown in FIG. 1, this flow rate is determined by sensing conditions of the actuator 11 which indicate the position of the inlet guide vanes 24. An electrical control signal indicative of the sensed conditions is supplied to the solenoid 45 via electrical lead 15. It should be noted that other volumetric flow rate measuring means may be used to control operation of the solenoid 45 and thus the position of the valve 44. For example, the valve 44 may be controlled in response to temperatures and/or pressures at locations in the refrigeration system which are indicative of the volumetric flow rate through the compressor 10.

In operation, when a relatively high volumetric vapor flow rate through the compressor 10 is detected, that is, when the volumetric vapor flow rate through the compressor 10 is equal to or greater than a predetermined flow rate corresponding to stable flow conditions for the compressor 10, then the solenoid 45 is operated to position the valve 44 so that the supply conduit 41 is connected to the low pressure conduit 42. Thus, a relatively low pressure is supplied to the cavity 29 resulting in a pressure difference across the throttle ring 30 which forces the throttle ring 30 to its minimum throttling position which is shown by the solid lines in FIG. 1.

The throttle ring 30 is positively maintained in its minimum throttling position by the pressure difference across the ring 30 against the action of the force produced by the resilient means 32. In this minimum throttling position vapor flow through the diffuser passageway 16 is essentially unrestricted. Because there is a pressure force positively maintaining the throttle ring in its minimum throttling position the throttle ring does not significantly vibrate when there are minor pressure variations in the diffuser passageway 16. In this manner, wear of the throttle ring 30 is reduced and noise from the ring 30 is prevented.

When a relatively low volumetric flow rate through the compressor 10 is detected, that is, when the volumetric vapor flow rate through the compressor 10 is less than the predetermined flow rate corresponding to stable flow conditions for the compressor 10, then the solenoid 45 is operated to position the valve 44 to connect the supply conduit 41 to the high pressure conduit 43. The throttle ring 30 is forced to its maximum throttling position by the pressure difference across the ring 30 due to the supply of the relatively high pressure to the cavity 29 behind the ring 30. This pressure difference across the ring 30 acts in addition to the action of the resilient means 32 to positively maintain the throttle ring 30 in its maximum throttling position which is shown by the broken lines in FIG. 1. This prevents undesirable vibrations of the throttle ring 30 due to minor pressure variations in the diffuser passageway 16 while restricting the diffuser passageway 16 to prevent undesirable flow reversals in the passageway 16 which may degrade the performance of the compressor 10.

Figure 2:
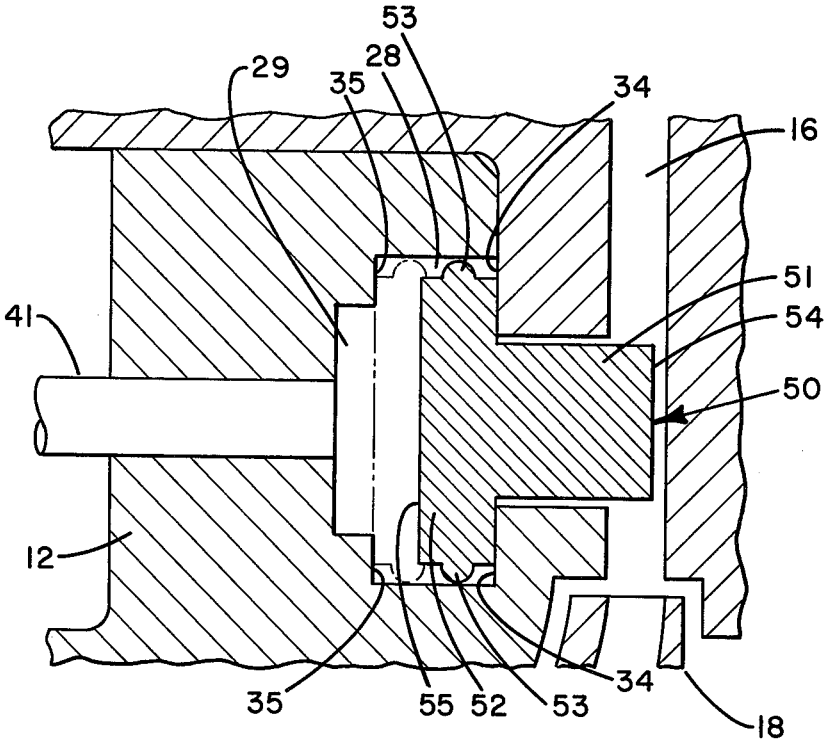
FIG. 2 is a schematic, cross-sectional view of a new, improved diffuser throttle ring, according to the present invention, which may be used as part of or in place of the spring biased diffuser throttle ring shown in FIG. 1.

Referring to FIG. 2, there is shown a schematic, cross-sectional view of a new, improved diffuser throttle ring 50, in accordance with the present invention, which may or may not be spring biased but which may be used in place of the spring biased diffuser throttle ring 30 shown in FIG. 1. This throttle ring 50 is a generally annular body having a front portion 51 with a front surface area 54 and a back portion 52 with a back surface area 55. The front portion 51 extends into the diffuser passageway 16 when the throttle ring 50 is in its maximum throttling position as shown by the solid lines of FIG. 2. The throttle ring 50 is movable to a minimum throttling position, shown by the dashed lines in FIG. 2, whereby the front surface 54 of the throttle ring 50 is flush with the walls of the diffuser passageway 16 to allow essentially unrestricted vapor flow through the diffuser passageway 16.

A sealing means 53 is part of the back portion 52 of the throttle ring 50. The sealing means 53 reduces friction to facilitate sliding of the throttle ring 50 in the annular recess 28 and provides a seal to prevent vapor flow between the cavity 29 behind the throttle ring 50 and the diffuser passageway 16. As shown in FIG. 2, the sealing means 53 is made of a relatively hard polymer material, such as nylon, sandwiched between the material making up the rest of the back portion 52 whereby the sealing means 53 is an integral part of the back portion 52. Alternatively, the sealing means 53 may be a ring (not shown) of relatively soft polymer material, such as nitrile, which is placed in a groove in the back portion 52 to form a seal between the walls of the annular recess 28 and the throttle ring 50 and to facilitate sliding of the throttle ring 50 in the annular recess 28.

In operation, the throttle ring 50 is controlled in much the same manner as the throttle ring 30 is controlled as discussed with respect to FIG. 1 except that spring biasing is not required to position the throttle ring 50. That is, the throttle ring 50 is positioned solely by controlled pressure differences across the ring 50. A low pressure source is connected to the supply conduit 41 to provide a low pressure in the cavity 29 when there is a relatively high volumetric vapor flow rate through the compressor 10 corresponding to stable flow conditions for the compressor 10. Alternatively, if the volumetric flow rate through the compressor 10 is at a relatively low level which is less than the predetermined flow rate corresponding to stable flow conditions for the compressor 10, then the supply conduit 41 is connected to a high pressure source to provide a relatively high pressure in the cavity 29.

When the low pressure source is connected to the cavity 29 this results in a pressure difference across the throttle ring 50 which forces the throttle ring 50 to its minimum throttling position. Also, the force due to the pressure difference across the throttle ring 50 positively maintains the throttle ring 50 in its minimum throttling position to prevent undesirable vibrations of the throttle ring 50 which may be caused by pressure variations in the diffuser passageway 16. This prevents undesirable wear of the ring 50 and prevents generation of undesirable noise which might result from vibrations of the throttle ring 50.

When the supply conduit 41 is connected to the high pressure source to provide a relatively high pressure in the cavity 29 this results in a pressure difference across the throttle ring 50 which forces the throttle ring 50 to its maximum throttling position. Also, this force due to the pressure difference across the throttle ring 50 positively maintains the ring 50 in its maximum throttling position to prevent undesirable vibrations of the ring 50 due to minor pressure variations in the diffuser passageway 16. This prevents undesirable wear of and noise from the throttle ring 50 which might result from vibrations of the ring 50.

As shown in FIG. 2 the diffuser throttle ring 50 is not spring biased in any manner. Therefore, if the diffuser throttle ring 50 is to properly move between its minimum and maximum throttling positions in response to the pressure difference across the ring 50 then the ring 50 must meet certain criteria. Essentially, the throttle ring 50 must be configured to meet the following conditions;

$$(p_{min})(A_1)>(P_2)(A_2)$$

and $$(P_{max})(A_1)<(P_3)(A_2)$$

where $P_{min}$ is the minimum vapor pressure expected in the diffuser passageway 16, $P_{max}$ is the maximum vapor pressure expected in the diffuser passageway 16, $P_2$ is the pressure of the low pressure source, $P_3$ is the pressure of the high pressure source, $A_1$ is the surface area 54 of the annular body 50 facing the diffuser passageway 16, and $A_2$ is the surface area 55 of the annular body 50 facing the cavity 29. Considering a typical example, if $P_{min}$ equals 18 psia, $P_{max}$ equals 35 psia, $P_2$ equals 10 psia, and $P_3$ equals 25 psia then the throttle ring 50 must be configured so that:

$$1.4(A_1)<A_2<1.8(A_1)$$

Further, it should be noted that the throttle ring 50 may be composed of any of a variety of materials and the diffuser throttle ring 50 may take any of a variety of shapes having various cross-sectional configurations. In addition, many other types of throttle rings, besides those described herein, may be used in accordance with the principles of the present invention.

Therefore, while the present invention has been described in conjunction with particular embodiments it is to be understood that various modifications and other embodiments of the present invention may be made without departing from the scope of the invention as described herein and as claimed in the appended claims.

What is claimed is:

1. A centrifugal vapor compressor comprising:

a housing forming an inlet passageway for directing vapor into the compressor and a diffuser passageway for directing compressed vapor out of the compressor, said diffuser including a wall with an annular recess therein;

an impeller rotatably mounted in the housing between the inlet passageway and the diffuser passageway;

a diffuser throttle ring mounted in the annular recess to form a substantially sealed cavity between the walls of the annular recess and the back surface of the throttle ring, said throttle ring supported in the annular recess for movement across the diffuser passageway between a minimum throttling position and a maximum throttling position;

control means for determining volumetric vapor flow rate through the compressor, and for generating a first control signal when the volumetric vapor flow rate through the compressor is equal to or greater than a predetermined flow rate corresponding to stable flow conditions for the compressor and a second control signal when the volumetric vapor flow rate through the compressor is less than the predetermined flow rate; and valve means for detecting the control signals generated by the control means, and for connecting the cavity behind the throttle ring to a relatively low pressure source to provide a pressure difference across the throttle ring which positively maintains the throttle ring at its minimum throttling position when the first control signal is detected, and for connecting the cavity behind the throttle ring to a relatively high pressure source to provide a pressure difference across the throttle ring which positively maintains the throttle ring at its maximum throttling position when the second control signal is detected.

2. A centrifugal vapor compressor as recited in claim 1 further comprising:

a resilient means for providing a force on the diffuser throttle ring which biases the throttle ring towards its maximum throttling position.

3. A centrifugal vapor compressor as recited in claim 1 wherein said diffuser throttle ring comprises:

a generally annular body mounted in the annular recess to form a cavity between the walls of the annular recess and the back surface of said body, said annular body including a front portion which extends into the diffuser passageway to control flow through the diffuser passageway depending on the axial location of the front part in the diffuser passageway, a back portion which is slidably mounted in the annular recess to limit the axial movement of the front part across the diffuser passageway between the minimum and maximum throttling positions, and a sealing means which is part of the back portion and which is in slidable contact with the walls of the annular recess to substantially prevent vapor flow between the cavity behind said annular body and the diffuser passageway, said front and back portions configured to meet the following conditions:

$$(P_{min})(A_1)>(P_2)(A_2)$$

and $$(P_{max})(A_1)<(P_3)(A_2)$$

where $P_{min}$ is the minimum vapor pressure expected in the diffuser passageway, $P_{max}$ is the maximum vapor pressure expected in the diffuser passageway, $P_2$ is the pressure of the low pressure source, $P_3$ is the pressure of the high pressure source, $A_1$ is the surface area of said annular body facing the diffuser passageway, and $A_2$ is the surface area of said annular body facing the cavity.

4. A method of operating a centrifugal vapor compressor having a pressure controlled diffuser throttle ring which is positioned in either a minimum throttling position or a maximum throttling position in response to pressure differences between pressure in the diffuser passageway and pressure in a cavity behind the throttle ring, which comprises:

determining the volumetric vapor flow rate through the compressor;

generating a first control signal when the detected flow rate is equal to or greater than a predetermined flow rate which corresponds to stable flow conditions for the compressor;

generating a second control signal when the detected flow rate is less than the predetermined rate;

connecting the cavity behind the throttle ring to a relatively low pressure source in response to generation of the first control signal to provide a pressure difference across the throttle ring to positively maintain the throttle ring in its minimum throttling position; and connecting the cavity behind the throttle ring to a relatively high pressure source in response to generation of the second control signal to provide a pressure difference across the throttle ring to positively maintain the throttle ring in its maximum throttling position.

5. A method of operating a centrifugal vapor compressor with a pressure controlled diffuser throttle ring as recited in claim 4, wherein the relatively low pressure source is the compressor suction pressure and wherein the relatively high pressure source is the compressor discharge pressure.

* * * * *